US007637494B2

(12) United States Patent
Wardak et al.

(10) Patent No.: US 7,637,494 B2
(45) Date of Patent: Dec. 29, 2009

(54) DEVICE FOR SEPARATING SHEETS OF A RECORDING MEDIUM

(75) Inventors: Andreas Wardak, Rottweil (DE); Markus Weber, Seedorf (DE)

(73) Assignee: BDT AG, Rottweil (DE)

( * ) Notice: Subject to any disclaimer, the term of this patent is extended or adjusted under 35 U.S.C. 154(b) by 289 days.

(21) Appl. No.: 11/198,969

(22) Filed: Aug. 8, 2005

(65) Prior Publication Data

US 2006/0033257 A1 Feb. 16, 2006

(30) Foreign Application Priority Data

Aug. 9, 2004 (DE) ..... 10 2004 038 753

(51) Int. Cl.
*B65H 3/52* (2006.01)

(52) U.S. Cl. ..... 271/121

(58) Field of Classification Search ..... 271/121, 271/122, 124, 167, 146, 137, 104
See application file for complete search history.

(56) References Cited

U.S. PATENT DOCUMENTS 6,318,715 B1 11/2001 Froechte ..... 271/117
6,322,065 B1 * 11/2001 Underwood et al. ..... 271/117
6,637,743 B2 * 10/2003 Underwood et al. ..... 271/117
2004/0017038 A1 * 1/2004 Underwood et al. ..... 271/117
2004/0046309 A1 * 3/2004 Lee et al. ..... 271/121

FOREIGN PATENT DOCUMENTS

DE 19950307 10/1999

* cited by examiner

*Primary Examiner*—Patrick H Mackey
*Assistant Examiner*—Thomas A Morrison
(74) *Attorney, Agent, or Firm*—Baker Botts L.L.P.

(57) ABSTRACT

A device for separating sheets of a recording medium has a feed head (22) that, together with feed rollers (58), lies on the top sheet of a horizontally arranged stack of the recording medium. The feed rollers (58) push the top sheet against a rising incline, so that its leading edge is lifted up and separated from the stack. The feed head (22) is arranged on an arm (18) that is designed to swivel freely on a swiveling plane that is parallel to the plane of the incline. In the feed head (22), the feed rollers (58) can move away from the incline parallel to the plane of the stack against the spring force.

7 Claims, 5 Drawing Sheets

DEVICE FOR SEPARATING SHEETS OF A RECORDING MEDIUM

CROSS-REFERENCE TO RELATED APPLICATION

This application claims priority to German Patent Application No. 10 2004 038 753.2, which was filed on Aug. 9, 2004, and is incorporated herein by reference in its entirety.

TECHNICAL FIELD

The invention relates to a device for separating sheets of a recording medium.

BACKGROUND

A device of this type is known from DE 199 50 307 C1. For this known device, a feed head, which has the feed rollers that push the top sheet of the stack against an incline, lies on the stack of sheets to be separated. The leading edge of the top sheet runs up the incline and is thereby separated from the following, second sheet of the stack. The feed head is attached to the free end of a swiveling arm, so that it can follow the height of the stack. In order for the leading edge of the top sheet to be pushed up the incline, the leading edge must be bent upward at the level of the stack. This requires a bending length between the leading edge of the sheet and the action line of the feed rollers, which is dependent upon various factors. Such factors include, for example, the paper weight, the paper structure, the humidity, etc. The feed rollers adjust automatically to the required bending length by rolling away from the incline-and thus from the leading edge of the paper that is bearing against this incline-against the retractive force of a spring, until the leading edge is pushed up the incline. In the known device, the swiveling motion of the arm is blocked by the force of the retractile spring as soon as the feed rollers move away from the incline. The feed rollers are supported in a rocker, whose setting angle increases in the feed head when the feed rollers move away from the incline. This increases the pressure force, and thus the friction of the feed rollers in relation to the top sheet, in order to ensure a reliable feeding of the top sheet.

This known device has proved to be successful in practice. Since in this known device the force of the retractile spring blocks the swiveling motion of the arm, no initial tension may exist in the retractile spring in the inoperative position. The feed rollers must therefore maintain a certain minimum distance from the incline, so that the feed rollers bearing against the incline do not cause an initial tension that blocks the swiveling motion of the arm that affects the retractile spring. It is important for the reliability of the sheet-separation, however, that the distance between the leading edge of the top sheet bearing against the incline and the action line of the feed rollers on this sheet be as small as possible, particularly if the sheets have only slight bending stiffness.

SUMMARY

The task of the invention is to further improve a device of the aforementioned type with regard to the reliability of sheet-separation.

This task can be fulfilled by a device for separating sheets of a recording medium, in which the sheets are stored in a stack that is essentially arranged horizontally; comprising a feed head that can be placed on a top sheet of the stack; at least one feed roller supported in the feed head, which can be driven in order to catch the top sheet of the stack by means of friction and, for single-feeding, push its leading edge against an incline that is contiguous to the stack and slopes upward in relation to the plane of the sheet, wherein the feed roller, while being driven in the feed head, moves away from the incline against a spring force on the top sheet until the leading edge of the sheet runs up the incline; and an arm that is designed to swivel lateral to the stack of sheets, that juts out above the stack lateral to the feeding direction of the sheets, and that bears the feed head on its free end, wherein the swiveling plane in relation to a plane that is perpendicular to the plane of the sheet and parallel to the sheet's leading edge is slanted toward the incline, and wherein the feed head is moved parallel during the swiveling motion of the arm and at least the one feed roller in the feed head can be moved parallel to the surface of the stack.

The swiveling plane of the arm may run parallel to the plane of the incline. The arm and a parallel rod, which is arranged parallel to the arm and which can be swiveled on the swiveling plane of the arm, may form a parallel guide for the feed head. The feed head may have a frame that is designed to swivel on the arm or, respectively, on the arm and the parallel rod, in which a sliding element is supported that runs parallel to the plane of the stack and perpendicular to the leading edge of the sheet, and in which the feed roller is supported. The sliding element can be shifted against the force of a spring in the frame. A motor for driving the feed roller can be arranged on the sliding element. At least the one feed roller can be held touching the incline by the spring force when the feed roller is not driven.

In the device according to the invention, the arm that holds the feed head can swivel and move freely. Thus, the feed head can freely follow the different stack heights of the recording medium and lies on the top sheet of the stack under only the weight of the arm and the feed head. The feed rollers are supported in the feed head in such a way that they can roll away from the incline against a spring force, parallel to the plane of the stack and thus to the top sheet of the stack. The swivel plane of the arm is tilted perpendicular to the plane of the stack and preferably runs parallel to the plane of the incline. Due to this incline of the arm's swiveling plane, the spring force acts on the feed rollers with a normal component perpendicular to the plane of the top sheet. This normal component is proportional to the spring force and thus increases when the spring force increases with the increasing distance of the feed rollers from the incline. The feed rollers are therefore pressed against the top sheet with an increasing normal force when they move away from the incline in order to adjust to the sheet stiffness. Since the spring force has no influence on the swiveling motion of the arm, the feed rollers can be under a certain initial tension of the spring even in the inoperative position. This means that the feed rollers can also bear directly against the incline, which can cause a slight initial tension to the retractile spring. It is therefore possible in the design to minimize the distance between the leading edge of the top sheet that is bearing against the incline and the action line of the feed rollers, so that even for sheets having very little bending stiffness, a double feeding of pages can be prevented with a high degree of reliability.

BRIEF DESCRIPTION OF THE DRAWINGS

The invention is described in more detail below using an embodiment example illustrated in the drawing. The drawing shows.

DETAILED DESCRIPTION

Single pages of a recording medium, particularly paper sheets, are stored in a stack 10, so that they can be individually fed for further processing. The further processing is performed, for example, in an office machine, such as, a printer, a copier, etc.

Figure 1:
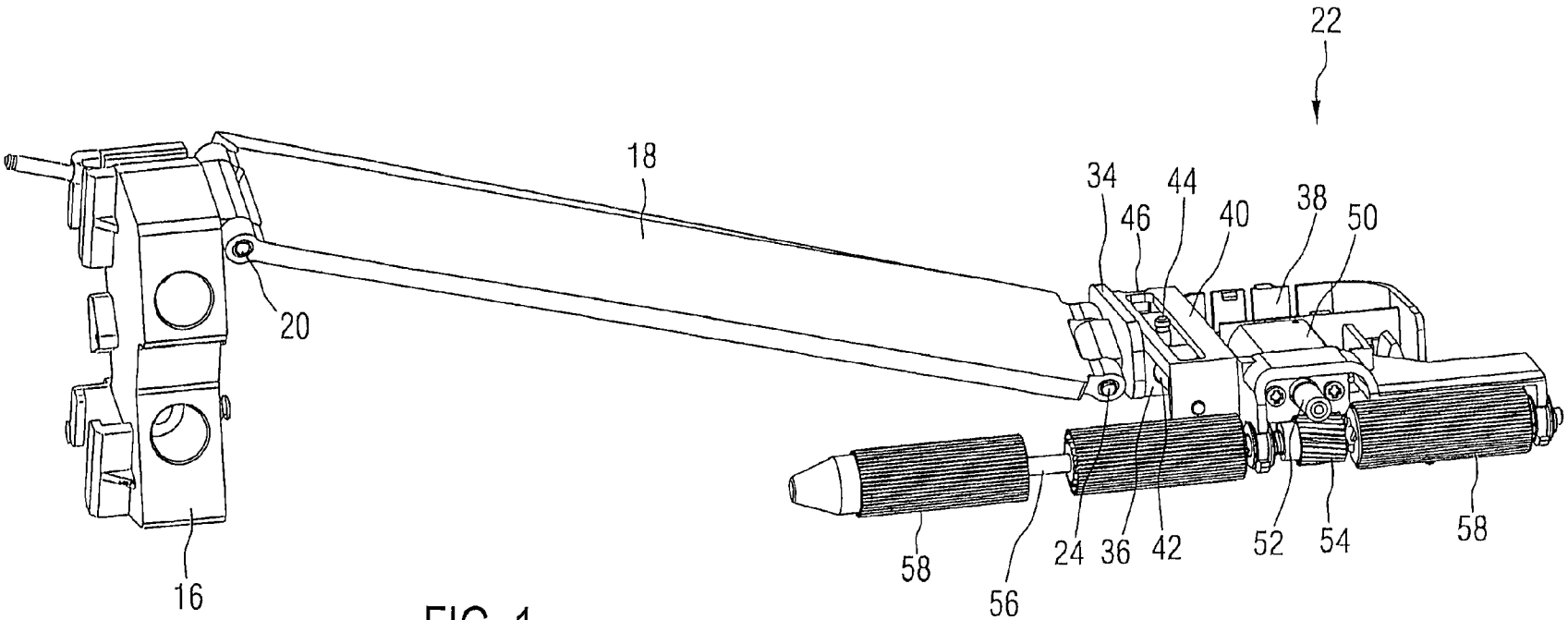
FIG. 1 a frontal view of the device.
Figure 2:
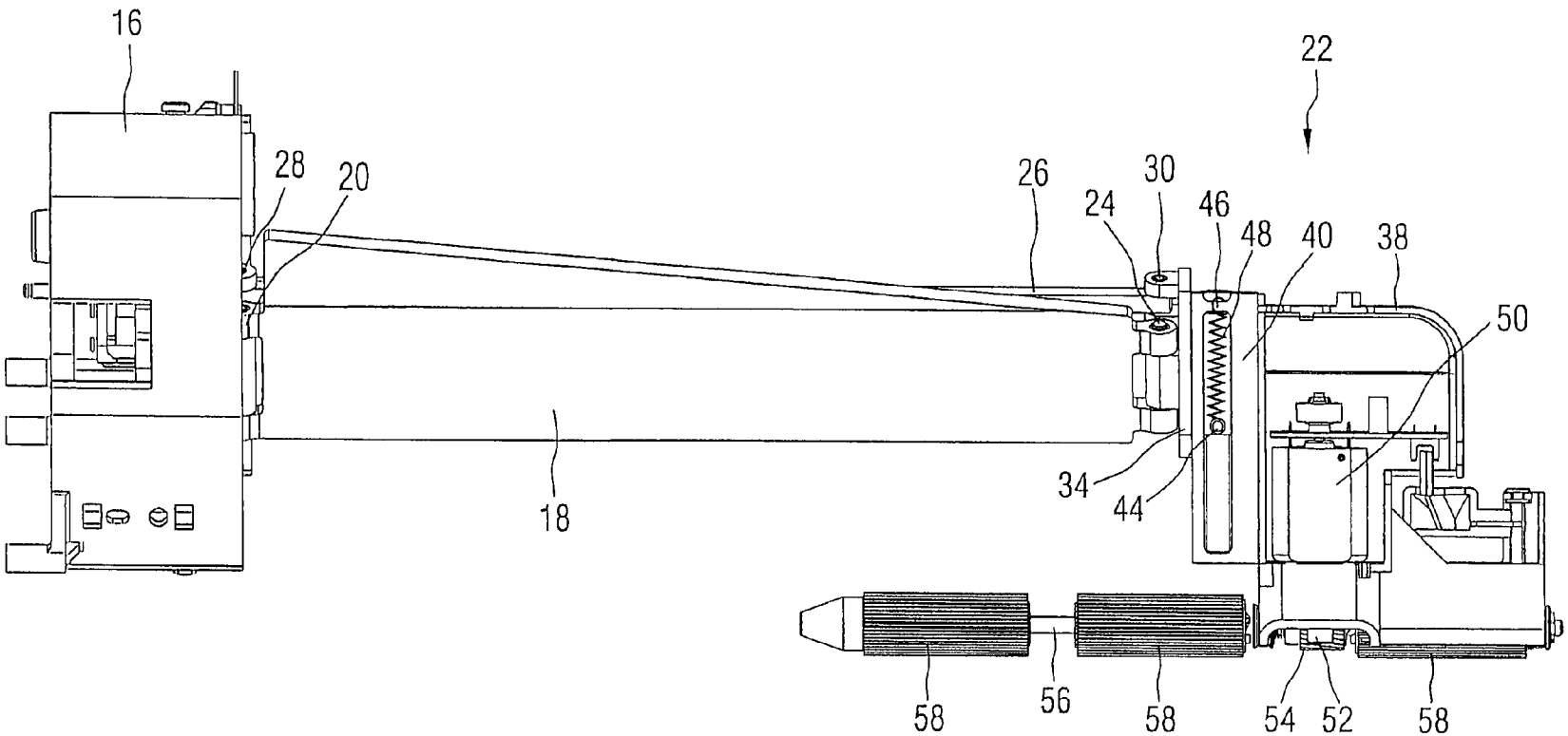
FIG. 2 a top view of the device.
Figure 3:
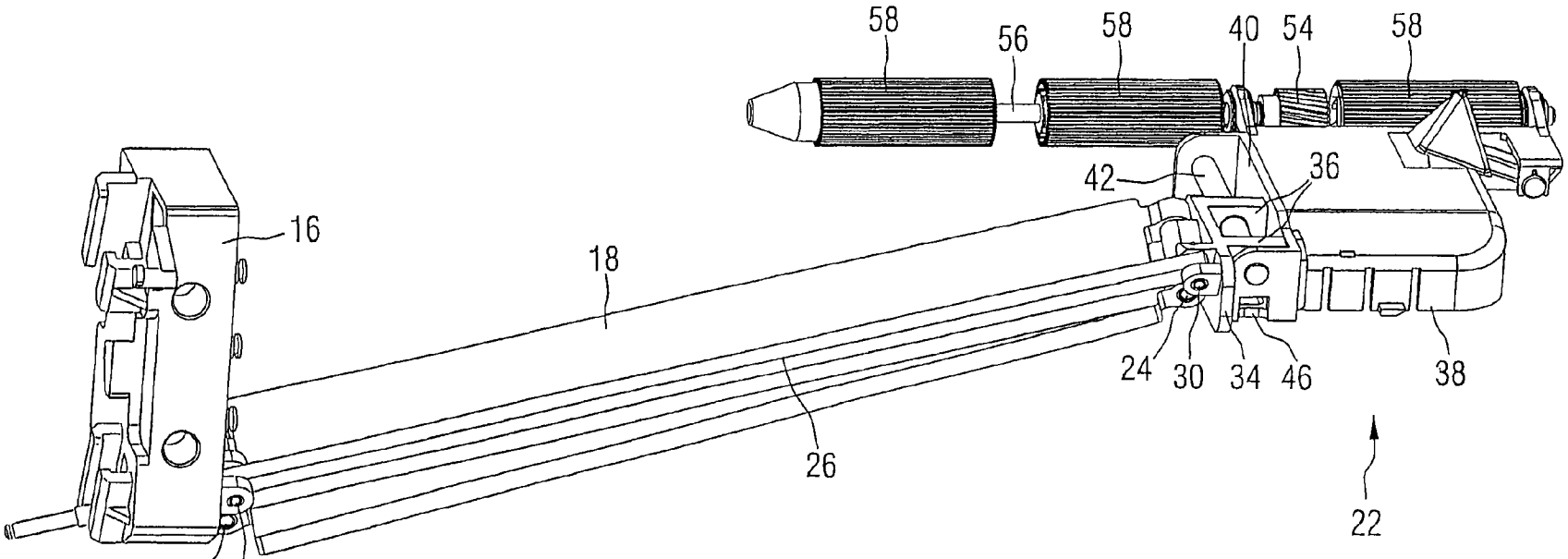
FIG. 3 a bottom view of the device.

The leading edge of stack 10 lies in the feeding direction at an incline 12. The incline 12 is designed as a flat surface that slopes away from the stack in the feeding direction of the sheets. The angle $\alpha$, which is formed by the plane of the incline 12 and the perpendicular to the plane of the stack 10, is preferably ca. 20 to 25°. The device illustrated in detail in FIGS. 1 to 3 is attached to an inner wall 14 of the recording space for the stack 10, which is perpendicular to the bearing surface of the stack 10 and to the incline 12.

A housing 16 is attached to the inner wall 14. On the wall of the housing 16, which is parallel to the inner wall 14 and perpendicular to the plane of the stack 10, a swiveling arm is supported around a first bearing axis 20. The first bearing axis 20 runs parallel to the plane of the inner wall 14 and is slanted at an angle to the plane of the stack 10, wherein this angle preferably corresponds to the angle $\alpha$ of the incline 12.

Due to this arrangement of the first bearing axis 20, the arm 18 can be swiveled on a plane that runs approximately parallel to the plane of the incline 12. If the first bearing axis 20 is arranged perpendicular to the incline 12, then the arm 18 can be precisely swiveled on a plane that is parallel to the plane of the incline 12.

The arm 18 juts out from the inner wall 14 or, respectively, from the housing 16, over the stack 10; and it supports a feed head 22 on its free end. The length of the arm 18 is sized in such a way that the feed head 22 is located approximately on the longitudinal centerline of the stack 10. The arm 18 is preferably designed as a wide plate, in order to have sufficient bending and torsional stiffness. Furthermore, this also results in a longer first bearing axis 20, which ensures that the arm 18 remains stable and is able to bear loads during tilting moments.

The feed head 22 is designed to swivel on the free end of the arm 18 by means of a second bearing axis 24. The second bearing axis 24 runs parallel to the first bearing axis 20. A parallel rod 26 running parallel to the arm 18 is arranged under the arm 18. The parallel rod 26 is attached by one arm to the wall of the housing 16 and is designed to swivel by means of a first bearing 28. The other end of the parallel rod 26 is designed to swivel on the feed head 22 by means of a second bearing 30. The axes of the first bearing 28 and the second bearing 30 run parallel to the first bearing axis 20 and the second bearing axis 24. The arm 18 and the parallel rod 26 thereby form a guide parallelogram that causes the feed head 22 to have a parallel up-and-down movement when the arm 18 swivels.

The feed head 22 has a frame 32. The frame 32 contains a flange plate 34, which is arranged parallel to the wall of the housing 16 and to which the arm 18 with the second bearing axis 24 and the parallel rod 26 is coupled with the second bearing 30. The parallelogram of the arm 18 and the parallel rod 26 cause the flange plate 34 to move parallel to the wall of the housing 16, and thus to the inner wall 14, during a swiveling motion of the arm 18.

Jutting out vertically from the flange plate 34 are two guides 36, each of which is comprised of a projection with a pilot hole that is formed on the flange plate 34. The guides 36 are separated from each other axially, whereby the pilot holes are aligned with each another on one axis that, on the one hand, is parallel to the flange plate 34 and, on the other hand, is parallel to the surface of the stack 10.

Furthermore, the feed head 22 has a sliding element 38 that wraps around the projections of the guides 36 with an angle bar 40. A guide rod 42 that is attached to the angle bar 40 fits into the pilot holes of the guides 36 in an axially slidable manner. In this way, the sliding element 38 is supported on the frame 32 so that it can slide axially in the direction of the guides 36 and the guide rod 42; however, in relation to the axis of the guide rod 42, it cannot pivot. Between a peg 44 attached to the front guide 36 and an end link 46 of the angle bar 40, a spring 48 (omitted in FIG. 1 for purposes of clarity) is loaded, which is depicted as a helical tension spring. The spring 48 thus pulls the sliding element 38 in the frame 32 forward in the direction of the incline 12. The sliding element 38 in the frame 32 can move away from the incline 12 against the force of the spring 48.

Naturally, the same spring force can also be exerted on the sliding element 38 by means of a compression spring, as is shown in FIGS. 5, 7, 8, and 9.

Furthermore, the sliding element 38 bears a drivable electrical motor 50, whose shaft, which is parallel to the guide rod 42, powers a worm gear by means of a worm. The worm gear 54 drives a shaft 56, which runs perpendicular to the guide rod 42 and parallel to the surface of the stack 10 by means of a free-wheel. Arranged on the shaft 56 are feed rollers 58 having torsional strength, which catch the top sheet of the stack 10 each time by means of friction.

Figure 4:
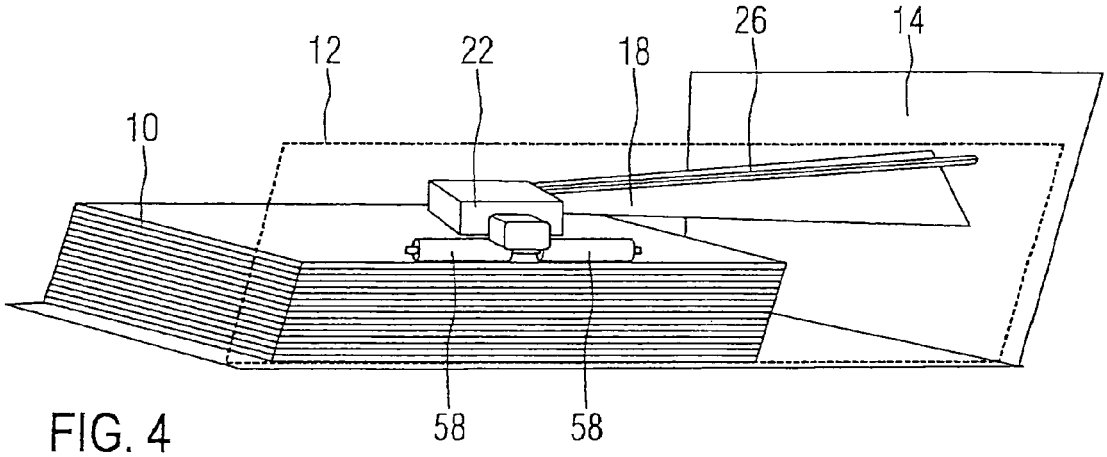
FIGS. 4-9 schematic drawings of the device in different operating states, and FIG. 10 a force diagram for explaining the function of the device.
Figure 5:
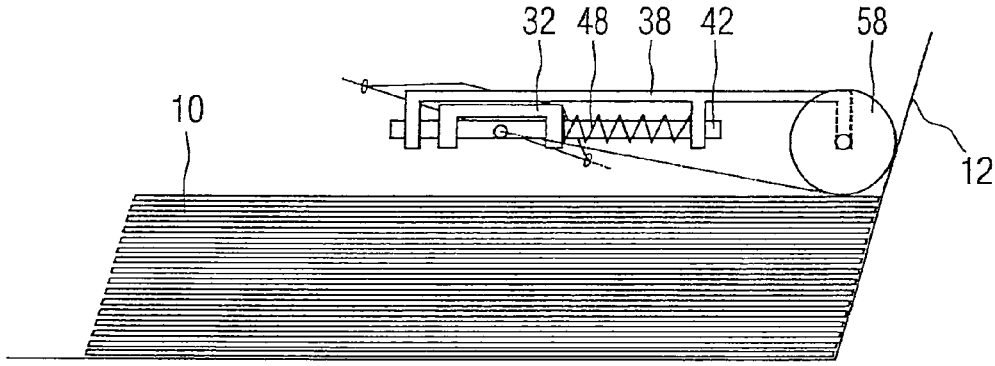
Figure 6:
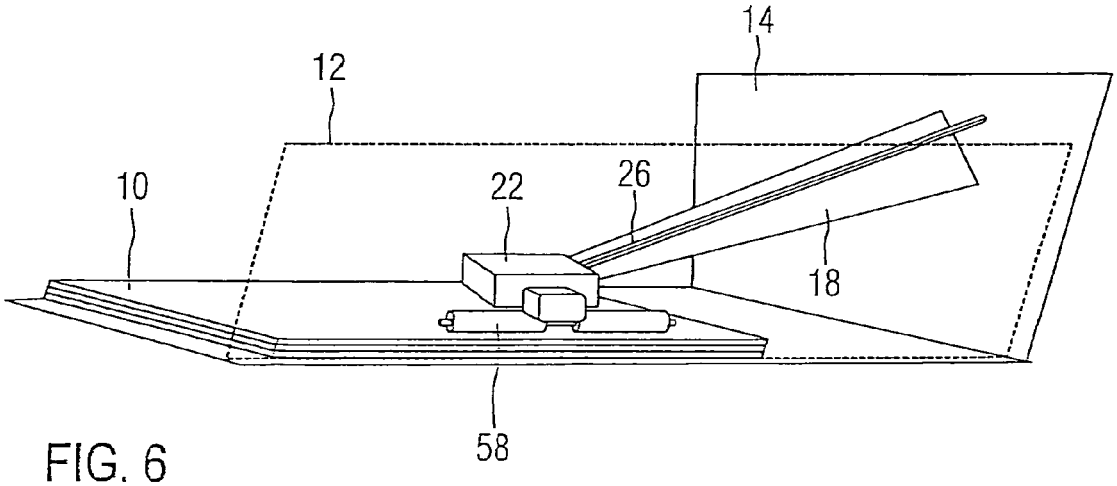
Figure 7:
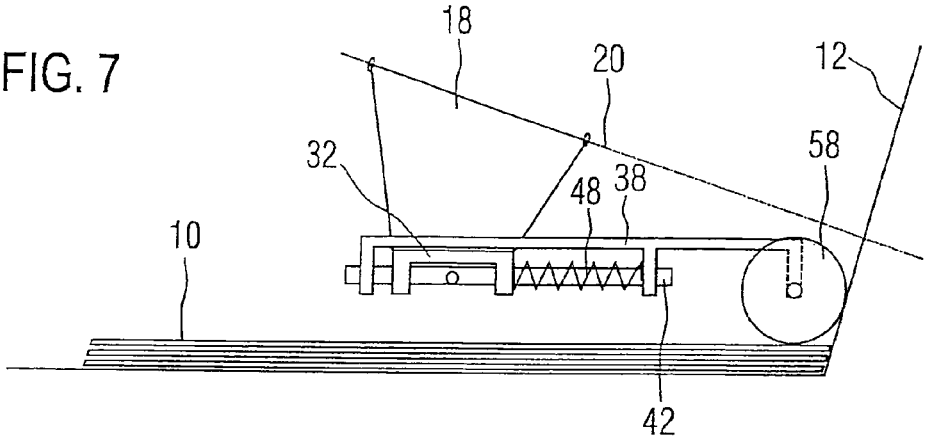

The device's manner of functioning is explained below using the schematic drawings of FIGS. 4 to 10:

FIGS. 4 and 5 show the device in the inoperative position, wherein the device is loaded with a full stack 10. FIGS. 6 and 7 show the device in the corresponding inoperative position, wherein, however, the stack 10 is already almost completely depleted. Since the arm 18 with the first bearing axis 20 is supported in a freely swiveling manner on the inner wall 14, the feed head 22, under its own weight and the weight of the arm, rests freely on the top sheet of the stack 10. If the height of the stack 10 is reduced by the removal of sheets, then the feed head 22 follows the decreasing stack, as a comparison of FIGS. 4 and 5 with FIGS. 6 and 7 shows. Due to the swiveling motion of the arm 18, the bearing position of the feed head 22 on the stack 10 moves slightly with regard to the longitudinal centerline of the stack 10, as a comparison of FIGS. 4 and 6 shows. The weight of the feed head 22 acts vertically on the top sheet of the stack 10. The weight component of the arm 18 that normally acts on the surface of the stack 10 is dependent upon the inclination angle of the first bearing axis 20. The larger that the inclination angle of the first bearing axis 20 is, the larger the weight component becomes that is received by the first bearing axis 20, and the smaller the weight component becomes that presses the feed head 22 vertically against the top sheet of the stack 10.

When the device is in the inoperative position, the motor 50 is not driven and powered, so that the feed rollers 58 are not driven. The feed rollers 58 therefore lie below normal force on the top sheet of the stack 10, which is determined by the weight of the feed head 22 and the normal component of the weight of the arm 18. The spring 48, which is shown as a compression spring in FIGS. 5, 7, 8, and 9 in contrast to the depiction in FIGS. 1 to 3, pushes the sliding element 38 forward until the feed rollers 58 bear against the incline 12.

Figure 8:
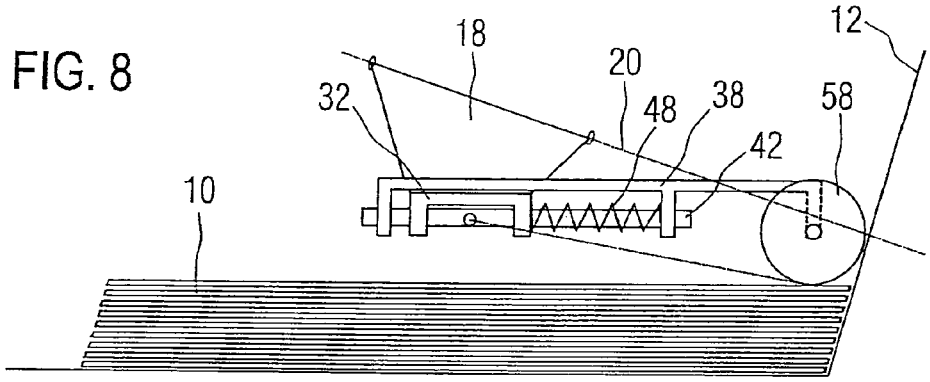
Figure 9:
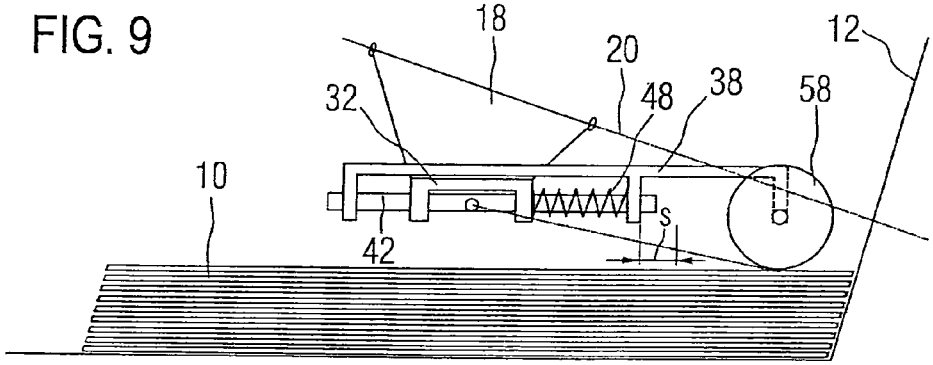
Figure 10:
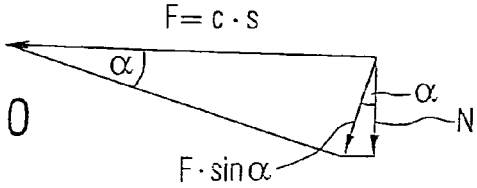

Upon receiving a sheet request signal, the motor 50 is powered and drives the feed rollers 58-in the depiction of FIGS. 4 to 9-in a counterclockwise direction. At first, the feed rollers 58 are positioned directly against the incline 12, as FIG. 8 shows. The powered feed rollers 58 exert a thrusting force onto the top sheet in the direction of the incline 12. Due to its angle of inclination, the incline 12 initially holds the top sheet in place, so that it does not move. As a result of this, the powered feed rollers 58 roll onto the top sheet of the stack 10 away from the inclination 12, as shown in FIG. 9. The sliding element 38 in the frame 32 is thereby shifted against the force of the spring 48. The feed rollers 58 move away from the incline 12, against the force of the spring 48, until the top sheet-dependent upon its stiffness and paper quality-can flex in the area between the feed rollers 58 and the leading edge of the sheet that is touching the incline 12, so that the leading edge of the sheet is pushed up at the incline 12, lifted up from the second sheet of the stack, and fed over the incline 12 for further transport. Since the top sheet now offers no resistance to the feeding by the feed rollers 58, the feed rollers 58 can be moved back into the starting position shown in FIG. 8 by the force of the spring 48. As soon as the leading edge of the top sheet is grasped by other subsequent transport means, the motor 50 is turned off again, and the remaining length of the top sheet can be pulled out from under the feed rollers 58, which are equipped with a free-wheel for this purpose.

It is essential for the invention that the normal force, with which the feed rollers 58 are pressed against the top sheet of the stack 10, increases when the feed rollers 58 move away from the incline 12. This is made clear by the force diagram in FIG. 10. The spring 48 exerts a pressure of $$F=c\cdot s$$

on the feed rollers 48, which acts in the direction of the guide rod 42. In this formula, c is the spring constant of spring 48, and s is the path of the sliding element 38 in the frame 32 in the direction of the guide rod 42 running parallel to the top sheet of the stack. The spring force F is supported by the arm 18. Since this can be swung horizontally under the angle $\alpha$, the bearing of the arm 18 receives a component of this spring force in the direction of the bearing axes 20 and 24. The force component $F\cdot\sin\alpha$, which is perpendicular to this component, acts in the direction of the swiveling plane of the arm 18. From this force component in the swiveling direction of the arm 18, on the other hand, a force component N acts perpendicular to the surface of the stack 10. This normal force caused by the spring 48 thus results in $$N=F\cdot\sin\alpha\cdot\cos\alpha=(c\cdot\sin\alpha\cdot\cos\alpha)\cdot s$$

Thus, added to the above-mentioned weight of the feed head 22 and the arm 18 is a normal force caused by the spring 48, which is proportional to the stroke path s by which the feed rollers 58 move away from the incline 12. When the feed rollers 58 move away from the incline 12, the pressure of the feed rollers 58 against the top sheet of the stack 10 thereby increases, which also increases the frictional force of the feed rollers 58 on the top sheet.

If the swiveling plane of arm 18 runs parallel to the plane of the incline 12, then, in the inoperative position, the swing of the sliding element 38 in the frame 32 is identical for each swiveling angle of the arm 18. The spring 48 therefore works in the same area of its spring-load deflection curve, regardless of the height of the stack 10.

In the inoperative position, the feed rollers 58 can bear directly against the incline 12, whereby, in this position, a certain initial tension of the spring 48 is also possible. Regardless of the quality of the paper in the stack 10, the device can become active immediately when the motor 50 is activated.

What is claimed is:

1. A device for separating sheets of a recording medium, in which the sheets are stored in a stack that is essentially arranged horizontally; comprising:

a feed head that can be placed on a top sheet of the stack;

at least one feed roller supported in the feed head, which can be driven in order to catch the top sheet of the stack by means of friction and, for single-feeding, push its leading edge against an incline that is contiguous to the stack and slopes upward in relation to the plane of the sheet, wherein the feed roller, while being driven in the feed head, moves away from the incline against a spring force on the top sheet until the leading edge of the sheet runs up the incline; and an arm that is designed to swivel, that is supported lateral to the stack of sheets, that juts out above the stack lateral to the feeding direction of the sheets, and that bears the feed head on its free end, wherein a plane in which the arm swivels, in relation to a plane that is perpendicular to the plane of the sheet and parallel to the sheet's leading edge, is slanted toward the incline, and wherein the feed head is movable parallel to the surface of the stack during the swiveling motion of the arm and the at least one feed roller in the feed head can be moved parallel to the surface of the stack during the swiveling motion of the arm.

2. A device according to claim 1, wherein the swiveling plane of the arm runs parallel to the plane of the incline.

3. A device according to claim 1, wherein the arm and a parallel rod, which is arranged parallel to the arm and which can be swiveled on the swiveling plane of the arm, form a parallel guide for the feed head.

4. A device according to claim 1, wherein the feed head has a frame that is designed to swivel on the arm or, respectively, on the arm and the parallel rod, in which a sliding element is supported that runs parallel to the plane of the stack and perpendicular to the leading edge of the sheet, and in which the feed roller is supported.

5. A device according to claim 4, wherein the sliding element can be shifted against the force of a spring in the frame.

6. A device according to claim 4, wherein a motor for driving the feed roller is arranged on the sliding element.

7. A device according to claim 1, wherein the at least one feed roller is held touching the incline by the spring force when the feed roller is not driven.

* * * * *